United States Patent [19]

Norton et al.

[11] Patent Number: 4,541,835

[45] **Date of Patent: * Sep. 17, 1985**

[54] FUELS

[75] Inventors: John H. R. Norton, Bromley, England; Peter R. Rebello, Edenvale, South Africa; Clifford M. Kavonic, Bedfordview, South Africa; Anthony J. Stiff, Edenvale, South Africa

[73] Assignee: AECI Limited, Johannesburg, South Africa

[ * ] Notice: The portion of the term of this patent subsequent to Sep. 17, 2002 has been disclaimed.

[21] Appl. No.: 352,880

[22] Filed: Feb. 26, 1982

Related U.S. Application Data

[63] Continuation-in-part of Ser. No. 207,616, Nov. 17, 1980.

[30] Foreign Application Priority Data

| | | | |
|---|---|---|---|
| Dec. 11, 1979 | [ZA] | South Africa | 79/6717 |
| Aug. 28, 1980 | [ZA] | South Africa | 80/5348 |
| Sep. 25, 1980 | [ZA] | South Africa | 80/5954 |

[51] Int. Cl.[4] ..... C10L 1/18; C10L 1/22

[52] U.S. Cl. ..... 44/53; 44/63; 44/71

[58] Field of Search ..... 44/53, 56, 63, 71, 77

[56] References Cited

U.S. PATENT DOCUMENTS 2,378,466 6/1945 Curme, Jr. ..... 44/57

OTHER PUBLICATIONS

English Translation of Brazilian Patent Application P17700392.

*Primary Examiner*—Jacqueline V. Howard
*Attorney, Agent, or Firm*—Cushman, Darby & Cushman

[57] ABSTRACT

The invention concerns a fuel comprising a mixture of (A) at least one alcohol with an average molecular weight of less than 160, and (B) at least one further organic compound which has a spontaneous ignition temperature of less than 450° C. The further organic compound is selected from (i) compounds which contain one nitrate group and at least two ether linkages, and (ii) compounds which contain two nitrate groups and at least one ether linkage.

8 Claims, No Drawings

FUELS

The application is a continuation-in-part of our earlier U.S. patent application Ser. No. 207,616, filed Nov. 17, 1980.

This invention relates to fuels, in particular fuels for compression ignition engines.

In our said earlier application, we stated that fuels may comprise a mixture of (A) at least one alcohol with an average molecular weight of less than 160, and (B) at least one further organic compound or mixture of organic compounds which together have a spontaneous ignition temperature of less than 450° C., said further organic compound or mixture being one or more of:

(1) a compound which contains one or more oxygen atoms but no nitrogen atoms, (2) a compound which contains one or more nitrate groups and one or more ether linkages, (an ether linkage being an oxygen atom linking two carbon atoms), or (3) a nitrogen-containing organic compound selected from the group consisting of azo compounds, tetrazines, nitroso compounds, nitro compounds, nitrate compounds, and hyponitrites.

Any combustible material is, by definition, a fuel in the broad meaning of the term. However, for a fuel to be suitable for use in particular applications, for example in internal combustion engines, the fuel generally will be required to exhibit further properties in addition to combustibility. In particular, fuels for compression-ignition (i.e. diesel-type) engines require the ability to ignite spontaneously under the high temperature conditions which occur in this class of engines at the end of the compression stroke, without additional ignition aids. In contrast, fuels for spark-ignition (ie gasoline-type) engines require a high resistance to oxidation and spontaneous ignition in order to avoid the destructive phenomenon of pre-ignition knock in the engine. The fuels for these two types of engine are not interchangeable.

It is desirable to utilize the lower alcohols, in particular methanol and ethanol, as fuels for internal combustion engines since these alcohols are a potential economic alternative to hydrocarbon fuels derives from oil. The spontaneous ignition properties of these alcohols make them suitable for use in spark-ignition engines but unsuitable for use in compression-ignition engines. However, since alcohols may be used as a gasoline substitute, it becomes even more desirable to seek a diesel fuel substitute since gasoline and diesel fuel are but different fractions from an oil barrel.

In principle, the ease of spontaneous ignition of a liquid combustible may be improved by the addition of ignition improvers (also known as ignition accelerators). A wide range of materials have been proposed as ignition improvers for hydrocarbon diesel fuel, and include aliphatic hydrocarbons, aldehydes, ketones, ethers, esters, alkyl nitrates, nitrites and nitro compounds, aromatic nitro compounds, peroxides, polysulphides, explosive nitrate esters, metal compounds, and the like.

For example, U.S. Pat. No. 2,378,466 (George O. Carme, Jr.) concerns diesel fuel and a method of improving diesel fuel ignition. Carme proposes adding a small proportion of a dinitrate of a poly 1,2-alkylene glycol to diesel fuel. A Brazilian Specification No. P 177 00392 (Daimler-Benz) discloses the use of ethyl alcohol and ethyl nitrates and nitrites as a fuel for diesel engines.

In a paper published subsequent to the filing of the Brazilian specification, the inventor of the proposal in the Brazilian specification (Dr. Horst Hardenberg) stated at the International Congress and Exposition in Detroit, Mich., in 1981, that ethyl nitrate had a disadvantage of explosion and required a 20% solution in ethanol but still gave unsatisfactory ignition quality. This is reported in a paper entitled 'Ignition Improvers for Ethanol Fuels', published by the Society of Automotive Engineers Inc., 400 Commonwealth Drive, Warrendale, Pa., pages 9 to 20.

It would appear reasonable to mix an ignition improver of proven effectivity in a hydrocarbon diesel fuel with a lower alcohol to produce a new fuel which exhibits the spontaneous ignition characteristics required for use in a compression-ignition engine. However, this is not the general case since most known ignition improvers are relatively ineffective when mixed with alcohols. One must consider the cetane number when concerning oneself with fuels for compression-ignition engines but consider the octane number when concerning oneself with fuels for spark-ignition engines. Examples of values are as follows:

| Compound | Octane number | Cetane number |
|---|---|---|
| n-heptane | 0 | 56 |
| n-decane | −41 | 76 |
| diesel (UK typical) | not measured | 52 |
| UK petrol (gasoline) | 91-101 | not measured |
| 2,methyl pentane | 83 | 33 |
| 2,2 4-trimethyl pentane (isooctane) | 100 | 12 |
| cyclohexane | 110 | 13 |
| methanol | 105 | about 3* |
| ethanol | 110 | about 8* |

*These values are approximate values taken from other literature.

The octane and cetane numbers have been obtained from 'technical data on fuel' by J. W. Rose and J. R. Cooper, 7th Edition, 1977, published by The British National Committee, World Energy Conference of 34 St. James Street, London SW 1 AIHD, pages 284 to 290.

An expert in the art can therefore only conclude that, if he is aware of a liquid combustible material, he may be able to use it as a fuel, but first he must carry out an inventive step to find a selected compound or group of compounds to mix with it for the combustible material to be suitable as a fuel. The expert in the art will also have to select the properties that are necessary for spark-ignition engines or for compression ignition engines to enable a fuel to be used for one or other of these two types of engine are not interchangeable.

We have now surprisingly found a fuel for an engine, said fuel being based on alcohols and on a very limited group of nitrates.

The present invention provides a fuel for a compression ignition engine and comprises a mixture of (A) at least one alcohol with an average molecular weight of less than 160, and (B) from 0,1% to 10% by volume, calculated on the alcohol, of at least one further organic compound or mixture of compounds which together have a spontaneous ignition temperature of less than 450° C., said further organic compound being selected from (i) compounds which contain one nitrate group and at least two ether linkages, and (ii) compounds which contain two nitrate groups and at least one ether linkage.

The invention also provides a method of running a compression ignition engine, which comprises injecting into the engine both (A) at least one alcohol with a molecular weight of less than 160, and (B) from 0,1 to 10% by volume, calculated on the alcohol, of at least one further organic compound or mixture of compounds which together have a spontaneous ignition temperature of less than 450° C., said further organic compound being selected from (i) compounds which contain one nitrate group and at least two ether linkages, and (ii) compounds which contain two nitrate groups and at least one ether linkage.

We have found that, when mixed with said alcohols, particularly methanol or ethanol, said further organic compounds up-rate the compression-ignition characteristics of said alcohols as compression-ignition fuels. Thus, these alcohols can be up-rated to form suitable fuels for naturally aspirated commercial compression-ignition engines by addition of the further organic compounds, where the alcohols are, without the added organic compounds, either less suitable or unsuitable for use as such fuels. Alcohols up-rated in this way can thus act as fuels in naturally aspirated commercial compression-ignition engines without the need for additional energy inputs and/or aids such as heated air aspiration, turbocharging, spark-ignition, abnormally high compression ratios or other additional energy sources and/or aids, although such additional energy sources and/or aids may be used, if desired. The further organic compounds act, when added in increasing amounts to fuels according to the invention which are barely capable of use in naturally aspirated compression-ignition engines, to increase power output and to cause said engines to run more smoothly.

The alcohol or mixture of alcohols forming component (A), conveniently has an average molecular weight of less than 90. Particularly preferred alcohols are methanol and ethanol.

Component (B) is an organic compound or mixture of organic compounds having a spontaneous ignition temperature of less than 450° C. The term 'spontaneous ignition temperature' is understood to mean the lowest temperature at which the material will ignite on its own in air. The organic compounds providing component (B), and which can be mixed with the alcohol, are poly -1,2-alkylene monoalkyl ether mononitrates containing two or more ether linkages, and poly -1,2-alkyleneglycol dinitrates containing one or more ether linkages.

Particular examples of compounds which can be mixed with methanol and/or ethanol are 2'-butoxy-2-ethoxy-ethyl nitrate, diethylene glycol dinitrate, triethylene glycol dinitrate and the dinitrates of polyethylene glycols of average molecular weights between 150 and 600, for example the dinitrate of average molecular weight 400.

When manufacturing a fuel, the fuel may be made by mixing the constituents together. If desired, a lubricant such as castor oil also may be added. Other organic, organometallic or inorganic materials may be added to the fuel, for example lubricants, stabilisers, corrosion inhibitors, ignition improvers, other fuels, fuel extenders and fuel additives.

When running an engine on the fuel, the components may be injected as a mixture. If desired, injection may be effected by utilizing an initial small amount, followed subsequently by a larger amount. If desired, diesel fuel may be injected as a mixture with the fuel of the invention or separately therefrom.

The invention is illustrated by reference to the following non-limiting Examples:

EXAMPLE 1

Various fuels were made by mixing together the constituents specified below. The mixture was then injected into a test compression-ignition engine. It was found that in every case ignition took place on compression of the engine, and the engine ran continuously under load. The fuels tested were the following constituents, the percentages being by volume:

| | | |
|---|---|---|
| (i) | 10.0% | 2'-Butoxyn-2-ethoxyethyl nitrate |
| | 90.0% | Methanol |
| (ii) | 10.0% | Diethylene glycol dinitrate |
| | 90.0% | Methanol |
| (iii) | 10.0% | Triethylene glycol dinitrate |
| | 90.0% | Methanol |
| (iv) | 10.0% | Polyethylene glycol 400 dinitrate |
| | 90.0% | Methanol |
| (v) | 4.0% | Triethylene glycol dinitrate |
| | 96.0% | Ethanol |
| (vi) | 4.0% | Triethylene glycol dinitrate |
| | 96.0% | Iso-propanol |
| (vii) | 1.0% | Triethylene glycol dinitrate |
| | 99.0% | n-Butanol |
| (viii) | 3.0% | Triethylene glycol dinitrate |
| | 97.0% | Iso-amyl alcohol |
| (ix) | 0.2% | Triethylene glycol dinitrate |
| | 99.8% | n-Octanol |
| (x) | 4.0% | Triethylene glycol dinitrate |
| | 67.2% | Ethanol |
| | 25.9% | Propanol |
| | 2.4% | Butanol |
| | 0.5% | Higher alcohols |
| (xi) | 1.6% | Triethylene Glycol dinitrate |
| | 0.8% | Methanol |
| | 1.6% | Ethanol |
| | 32.0% | Butanol |
| | 16.0% | Pentanol |
| | 32.0% | Octanol |
| | 16.0% | Dodecanol |
| (xii) | 5.0% | Triethylene glycol dinitrate |
| | 75.0% | Methanol |
| | 14.0% | Ethanol |
| | 5.4% | Propanol |
| | 0.6% | Butanol |
| (xiii) | 9.0% | Triethylene glycol dinitrate |
| | 1.0% | Methanol |
| | 90.0% | Acetone |
| (xiv) | 10.0% | Triethylene glycol dinitrate |
| | 10.0% | Methanol |
| | 80.0% | Methyl formate |
| (xv) | 5.0% | Triethylene glycol dinitrate |
| | 80.0% | Methanol |
| | 15.0% | Furfural. |

EXAMPLE 2

A fuel comprising 5% triethylene glycol dinitrate, 2% castor oil, and 93% methanol was injected into a 7,45 kw twin-cylinder, naturally aspirated diesel engine coupled to an electrical generator. The fuel was found to start the engine from cold (ambient temperature 10° C.) and run the engine satisfactorily at the rated power output.

EXAMPLE 3

A fuel comprising 10% triethylene glycol dinitrate, 2% Castor oil and 88% methanol was injected into a 3,5 liter 4-cylinder diesel-engined vehicle, whilst inducting a further quantity of methanol into the engine via the air inlet manifold. Using this fuel the vehicle could be driven satisfactorily.

The data given in U.S. Pat. No. 2,378,466 (Carme), on page 2, following line 32, compares the effectiveness of poly-1,2-alkylene glycol dinitrates with the commonly used ignition accelerator, ethyl nitrate, and demonstrates that the former are up to about 50% more effective. For example, the table shows that the addition of 1,5% of ethyl nitrate to a 25,6 cetane number diesel fuel increases the cetane number of the fuel by 20, whereas the addition of the same quantity of triethylene glycol dinitrate to the same fuel, increases the cetane number by 28,4 (an improvement of 42%). The Carme specification further discloses that the addition of poly-1,2-alkylene glycol dinitrates to a diesel fuel will decrease the ignition delay. Such diesel fuels will, even without such addition, undergo spontaneous combustion in a conventional diesel engine. The addition serves to reduce the delay between injection and spontaneous ignition, thus rendering the fuel more suitable for use in diesel engines.

On the other hand, we have found that poly-1,2-alkylene glycol dinitrates are surprisingly effective as ignition promoters for lower alcohols which will not, without the addition of such ignition promoters, undergo spontaneous combustion in a conventional diesel engine. We have found that additions of up to 20% by volume of ethyl nitrate fails to cause ignition of methanol in a test diesel engine (in fact, an air-cooled single cylinder compression ratio 15,7:1 engine).

On the other hand, additions of only 3% by volume of the compounds falling within the definition of component (B) will cause ignition. Thus, only 3% by volume of diethylene glycol dinitrate, triethylene glycol dinitrate, or polyethylene glycol 400 dinitrate, added by way of example, to methanol, causes ignition and permits continuous running of the engine.

It is apparent that the said compounds which cause ignition in amounts of only 3% by volume, are over 600% more efficient, compared with ethyl nitrate, as ignition improvers for alcohol fuels.

Additions of 5% by volume of components (B) to methanol forms fuels which perform in a similar manner to 45 cetane diesel. For example, the ability to start from cold was less than 5 seconds to reach 1500 r.p.m., with the engine at 10° C. There was smoothness in running, maximum power (3 Kw) and an ignition delay (10° crank angle at 1500 r.p.m. at 10% load). These results were substantially the same for a fuel according to the invention, containing only 5% by volume of component (B) and for a 45 cetane diesel fuel.

We claim:

1. A fuel for a compression ignition engine and consisting esentially of a mixture of (A) at least one alcohol selected from the group consisting of methanol and ethanol as the essential fuel component, and (B) from 0.1% to 10% by volume, calculated on the alcohol, of at least one further organic compound or mixture of compounds which together have a spontaneous ignition temperature of less than 450° C., said further organic compound being selected from poly -1,2-alkylene monoalkyl ether mononitrates containing two or more ether linkages, and poly -1,2-alkyleneglycol dinitrates containing one or more ether linkages.

2. A fuel as claimed in claim 1, wherein the fuel contains, as component (B), the compound 2'-butoxy-2-ethoxy ethyl nitrate.

3. A fuel as claimed in claim 1, wherein the fuel contains, as component (B), diethylene glycol dinitrate.

4. A fuel as claimed in claim 1, wherein the fuel contains, as component (B), the compound triethylene glycol dinitrate.

5. A fuel as claimed in claim 1, wherein the fuel contains, as component (B), the dinitrate of polyethylene glycol of an average molecular weight of 400.

6. A method of running a compression-ignition engine, which comprises injecting and/or inducting into the engine a fuel according to claim 1.

7. A method as claimed in claim 6, wherein component (B) is 2'-butoxy-2-ethoxy ethyl nitrate.

8. A method as claimed in claim 6, wherein the component (B) is selected from diethylene glycol dinitrate; triethylene glycol dinitrate, and the dinitrate of polyethylene glycol of an average molecular weight of 400.

* * * * *